US010940515B2

(12) United States Patent
Tachibana et al.

(10) Patent No.: US 10,940,515 B2
(45) Date of Patent: Mar. 9, 2021

(54) MILLING APPARATUS

(71) Applicant: MITSUBISHI HEAVY INDUSTRIES, LTD., Tokyo (JP)

(72) Inventors: Takahiro Tachibana, Tokyo (JP); Shigeru Maeda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 531 days.

(21) Appl. No.: 15/568,546

(22) PCT Filed: Apr. 25, 2016

(86) PCT No.: PCT/JP2016/062926

§ 371 (c)(1),
(2) Date: Oct. 23, 2017

(87) PCT Pub. No.: WO2016/175174

PCT Pub. Date: Nov. 3, 2016

(65) Prior Publication Data

US 2018/0117651 A1 May 3, 2018

(30) Foreign Application Priority Data

Apr. 27, 2015 (JP) ..... JP2015-090310

(51) Int. Cl.
*B21B 13/12* (2006.01)
*B21B 27/02* (2006.01)
(Continued)

(52) U.S. Cl.
CPC ..... *B21B 13/12* (2013.01); *B21B 1/088* (2013.01); *B21B 1/095* (2013.01); *B21B 13/005* (2013.01);
(Continued)

(58) Field of Classification Search
CPC ..... B21B 1/085; B21B 1/088; B21B 1/09; B21B 1/38; B21B 13/005; B21B 13/08;
(Continued)

(56) References Cited

U.S. PATENT DOCUMENTS 2,361,729 A * 10/1944 Cords ..... B21B 1/092 72/225
3,071,855 A * 1/1963 Mineah ..... B21B 1/088 228/125
(Continued)

FOREIGN PATENT DOCUMENTS

CA 2091108 A1 9/1993
EP 0560091 A1 3/1993
(Continued)

OTHER PUBLICATIONS

Translation of Akira et al, JP-633039301, Translated Jun. 24, 2020 (Year: 1987).*
(Continued)

*Primary Examiner* — Debra M Sullivan
*Assistant Examiner* — Matthew Kresse
(74) *Attorney, Agent, or Firm* — Kanesaka Berner and Partners, LLP

(57) ABSTRACT

A milling apparatus includes a plurality of milling roller units each including one milling roller that is made contact with, by pressing, one surface of one of a plurality of differently angled plate parts of an elongated metal milling material and another milling roller that is made contact with another surface of the plate part by pressing. At least one of the milling roller units mills a plate part different from a plate part milled by any other milling roller unit. A plurality of the milling roller units configured to mill an identical plate part are installed in a longitudinal direction of the plate part. The one milling roller and the other milling roller of at
(Continued)

least one of the milling roller units are movable in axial directions thereof.

6 Claims, 11 Drawing Sheets

(51) Int. Cl.

| | |
|---|---|
| ***B21B 29/00*** | (2006.01) |
| ***B21B 31/18*** | (2006.01) |
| ***B21B 1/088*** | (2006.01) |
| ***B21B 1/095*** | (2006.01) |
| ***B21B 13/00*** | (2006.01) |
| ***B21B 27/00*** | (2006.01) |
| ***B21B 13/14*** | (2006.01) |

(52) U.S. Cl.
CPC ..... *B21B 27/02* (2013.01); *B21B 29/00* (2013.01); *B21B 31/18* (2013.01); *B21B 13/145* (2013.01); *B21B 27/00* (2013.01)

(58) Field of Classification Search
CPC . B21B 13/14; B21B 13/142; B21B 2001/383; B21B 2001/386; B21B 2269/12; B21B 2269/14; B21B 2269/16; B21B 2269/18; B21B 31/18; B21B 2203/187; B21B 2205/04; B21D 5/06; B21D 5/08; B21D 5/083
See application file for complete search history.

(56) References Cited

U.S. PATENT DOCUMENTS

| | | | | | |
|---|---|---|---|---|---|
| 3,335,596 | A * | 8/1967 | Noda | B21H 8/00 | 72/194 |
| 3,803,888 | A * | 4/1974 | Hostetter | B21B 27/10 | 72/45 |
| 4,106,551 | A * | 8/1978 | Inoue | B22D 11/009 | 164/448 |
| 4,295,354 | A * | 10/1981 | Itoh | B21B 1/088 | 72/225 |
| 4,446,712 | A * | 5/1984 | Stone | B21B 13/005 | 72/241.2 |
| 4,685,319 | A * | 8/1987 | Aoyagi | B21B 1/088 | 72/177 |
| 5,031,435 | A | 7/1991 | Seto et al. | | |
| 5,042,281 | A * | 8/1991 | Metcalfe | B21B 9/00 | 219/81 |
| 5,052,206 | A * | 10/1991 | Reismann | B21B 31/16 | 72/13.4 |
| 5,203,193 | A * | 4/1993 | Iguchi | B21B 1/088 | 72/225 |
| 6,321,583 | B1 * | 11/2001 | Ikezaki | B21B 1/088 | 72/225 |
| 7,043,953 | B2 * | 5/2006 | Engel | B21B 1/088 | 72/200 |
| 7,257,978 | B2 * | 8/2007 | Koppinen | B21B 13/005 | 72/241.2 |
| 7,556,454 | B2 * | 7/2009 | Cable | E02D 5/28 | 405/231 |
| 10,421,106 | B2 * | 9/2019 | Norikura | B21B 13/14 | |
| 2002/0112514 | A1 * | 8/2002 | Hartmann | B21B 37/16 | 72/7.6 |
| 2010/0088882 | A1 | 4/2010 | Tomizawa et al. | | |

FOREIGN PATENT DOCUMENTS

| | | | | | |
|---|---|---|---|---|---|
| JP | 59-189019 | A | | 10/1984 | |
| JP | 59-202101 | A | | 11/1984 | |
| JP | 63-309301 | | * | 6/1987 | B21B 1/088 |
| JP | 1-317607 | A | | 12/1989 | |
| JP | 2-112801 | A | | 4/1990 | |
| JP | 05146802 | A | * | 6/1993 | B21B 1/38 |
| JP | H-08-032331 | B2 | * | 3/1996 | B21B 1/088 |
| JP | 2010-12497 | A | | 1/2010 | |
| JP | 2012-148288 | | * | 1/2011 | B21D 3/05 |
| JP | 2012-148288 | A | | 8/2012 | |
| JP | 2014-208370 | A | | 11/2014 | |
| WO | 2008/123505 | A1 | | 10/2008 | |

OTHER PUBLICATIONS

Translation of Ono et al, JP-2012148288, Translated Jun. 23, 2020 (Year: 2011).*
Translation of Akira et al, JPH-0832331-B2 (JPS-63309301-A), Translated Jun. 24, 2020 (Year: 1996).*
Translation of Hod et al, JP-05146802A, Translated Jun. 23, 2020 (Year: 1993).*
Written Opinion in PCT/JP2016/062926, dated Jul. 26, 2016. 9pp.
International Search Report in PCT/JP2016/062926, dated Jul. 26, 2016. 7pp.
Partial Supplementary European Search Report in EP Application No. 16786451.1, dated Feb. 1, 2018. 14pp.

* cited by examiner

MILLING APPARATUS

RELATED APPLICATIONS

The present application is a National phase of International Application No. PCT/JP2016/062926, filed Apr. 25, 2016, and claims priority based on Japanese Patent Application No. 2015-090310, filed Apr. 27, 2015.

TECHNICAL FIELD

The present invention relates to a milling apparatus configured to mill an elongated metallic material through a plurality of milling rollers.

BACKGROUND ART

For example, Patent Literature 1 (hereinafter, "PTL 1") discloses a milling apparatus in which an elongated material (metallic material) to be curved is fed in the longitudinal direction thereof and curved through a plurality of milling rollers being pressed against the material. This fabrication is called rolling fabrication.

As illustrated in FIG. 2 in PTL 1, such a milling apparatus includes a milling roller 21 that is made contact with one surface of a predetermined plate part (such as a web 11 or a flange 12) of a milling material (such as an H-shaped steel 10) by pressing and a milling roller 22 that is made contact with the other surface by pressing. The plate part such as the web 11 or the flange 12 is fed through the rollers 21 and 22 in the longitudinal direction thereof to mill the milling material such as the H-shaped steel 10 at a predetermined thickness.

CITATION LIST

Patent Literature

{PTL 1}
Japanese Unexamined Patent Application, Publication No. 2014-208370

SUMMARY OF INVENTION

Technical Problem

In the above-described milling apparatus, when the width of a plate part to be milled in the milling material is changed, in other words, when the width of the plate part differs from the widths of the milling rollers, the milling rollers need to be replaced with those having different widths, taking time to replace them. In addition, a production line needs to be stopped during the replacement work of milling rollers, which degrades productivity of the milling material.

When a milling material, such as an H-shaped steel or a channel-shaped steel, having a sectional shape formed by connecting a plurality of differently angled plate parts is milled, a support unit of any milling roller supported at both ends interferes with a plate part not to be milled, which prevents pressing by the milling roller up to a basal part of a plate part to be milled. Thus, the milling roller needs to be cantilevered, but with this configuration, sufficient milling force cannot be applied near a leading end side (not-supported side) of the cantilevered milling roller.

In addition, when a setting angle between two plate parts is less than 90° (acute angle), the cantilevered milling roller cannot mill a region near a corner of the setting angle between the plate parts.

The present invention is made in view of these circumstances and aims at providing a milling apparatus that can mill plate parts having different widths without replacing a milling roller, can reliably perform milling up to basal parts of a plurality of differently angled plate parts, and can mill a region near a corner of an acute setting angle between two plate parts.

Solution to Problem

To solve the above-described problems, the present invention employs the following solution:

A milling apparatus according to a first aspect of the present invention is a milling apparatus capable of milling at least one of a plurality of differently angled plate parts of an elongated metal milling material. The milling apparatus includes a plurality of milling roller units each including one milling roller that is made contact with one surface of the plate part by pressing and another milling roller that is made contact with another surface of the plate part by pressing. At least two of the milling roller units are installed in a longitudinal direction of one of the plate parts to mill the plate part. The one milling roller and the other milling roller of at least one of the at least two milling roller units are movable in axial directions of the milling rollers.

In the milling apparatus having the above-described configuration, the one milling roller and the other milling roller of at least one of the plurality of milling roller units installed in the longitudinal direction of the one plate part are movable in the axial directions of the milling rollers, which is the transverse direction of the milled plate part.

With this configuration, when the width of the milled plate part is larger than the width of the milling roller of each milling roller unit, the milling rollers of one milling roller unit are placed at an offset position corresponding to one side of the plate part in the width direction, and the milling rollers of another milling roller unit are placed at an offset position corresponding to the other side of the plate part in the width direction, which allows milling of the entire width of the plate part.

Thus, only the offset amounts of the milling rollers need to be changed at the change of the width of the plate part, and plate parts having different widths can be milled without replacing the milling rollers.

In the above-described configuration, at least one of the milling rollers of at least one of the milling roller units is cantilevered and pressed against the plate parts by a separately provided pressing roller.

In the milling apparatus having the above-described configuration, at least one of the milling rollers of at least one of the milling roller units is cantilevered and pressed, by the separately provided pressing roller, against a plate part to be milled.

When a milling material having a sectional shape formed by connecting a plurality of differently angled plate parts is milled, a leading end side (not-supported side) of a cantilevered milling roller is placed facing toward a side of a setting angle between the plate parts to be milled.

With this configuration, while a support unit of the milling roller is prevented from interfering with a plate part not to be milled, the milling roller can be pressed against plate parts to be milled, up to a position near a corner of a setting angle between the plate parts. In this manner, milling can be reliably performed up to basal parts of a plurality of differently angled plate parts.

A milling apparatus according to a second aspect of the present invention is a milling apparatus capable of simultaneously milling at least two of a plurality of differently angled plate parts of an elongated metal milling material. The milling apparatus includes a plurality of milling roller units each including one milling roller that is made contact with one surface of the plate part by pressing and another milling roller that is made contact with another surface of the plate part by pressing. At least one of the milling roller units mills the plate part different from the plate part milled by any other milling roller unit. A plurality of the milling roller units configured to mill an identical plate part are installed in a longitudinal direction of the plate part. The one milling roller and the other milling roller of at least one of the milling roller units are movable in axial directions of the milling rollers.

In the milling apparatus having the above-described configuration, similarly to the first aspect, the one milling roller and the other milling roller of at least one of the plurality of milling roller units installed in the longitudinal direction of the one plate part are movable in the axial directions of the milling rollers, which is the transverse direction of the milled plate part.

With this configuration, when the width of the milled plate part is larger than the width of the milling roller of each milling roller unit, the milling rollers of one milling roller unit are placed at an offset position corresponding to one side of the plate part in the width direction, and the milling rollers of another milling roller unit are placed at an offset position corresponding to the other side of the plate part in the width direction, which allows milling of the entire width of the plate part.

Thus, only the offset amounts of the milling rollers need to be changed at the change of the width of the plate part, and plate parts having different widths can be milled without replacing the milling rollers.

A milling apparatus according to a third aspect of the present invention is a milling apparatus capable of simultaneously milling at least two of a plurality of differently angled plate parts of an elongated metal milling material. The milling apparatus includes a plurality of milling roller units each including one milling roller that is made contact with one surface of the plate part by pressing and another milling roller that is made contact with another surface of the plate part by pressing. At least one of the milling roller units mills the plate part different from the plate part milled by any other milling roller unit. At least one of the milling rollers of at least one of the milling roller units is cantilevered and pressed against the plate parts by a separately provided pressing roller.

In the milling apparatus having the above-described configuration, at least one of the milling rollers of at least one of the milling roller units is cantilevered and pressed, by the separately provided pressing roller, against a plate part to be milled.

When a milling material having a sectional shape formed by connecting a plurality of differently angled plate parts is milled, a leading end side (not-supported side) of a cantilevered milling roller is placed facing toward a side of a setting angle between the plate parts to be milled.

With this configuration, while a support unit of the milling roller is prevented from interfering with a plate part not to be milled, the milling roller can be pressed against plate parts to be milled, up to a position near a corner of a setting angle between the plate parts. In this manner, milling can be reliably performed up to basal parts of a plurality of differently angled plate parts.

A milling apparatus according to a fourth aspect of the present invention is a milling apparatus capable of simultaneously milling at least two of a plurality of differently angled plate parts of an elongated metal milling material. The milling apparatus includes a plurality of milling roller units each including one milling roller that is made contact with one surface of the plate part by pressing and another milling roller that is made contact with another surface of the plate part by pressing. At least one of the milling roller units mills the plate part different from the plate part milled by any other milling roller unit. A plurality of the milling roller units configured to mill an identical plate part are installed in a longitudinal direction of the plate part. The one milling roller and the other milling roller of at least one of the milling roller units are movable in axial directions of the milling rollers. At least one of the milling rollers of at least one of the milling roller units is cantilevered and pressed against the plate parts by a separately provided pressing roller.

In the milling apparatus having the above-described configuration, similarly to the milling apparatus according to the first aspect of the present invention, only the offset amounts of the milling rollers need to be changed at the change of the width of the plate part, and plate parts having different widths can be milled without replacing the milling rollers.

In the milling apparatus having the above-described configuration, similarly to the milling apparatus according to the second aspect of the present invention, while a support unit of a milling roller is prevented from interfering a plate part not to be milled, the milling roller can be pressed against plate parts to be milled, up to a position near a corner of a setting angle between the plate parts. In this manner, milling can be reliably performed up to basal parts of a plurality of differently angled plate parts.

In the first, third, or fourth aspect, it is preferable that the angle of an axis line of the pressing roller is changeable to align with a direction along an outer peripheral surface of the milling roller pressed by the pressing roller.

With this configuration, when a conical roller is used as a milling roller, a pressing roller can be reliably pressed against the conical outer peripheral surface of the milling roller, thereby applying pressing force.

In any one of the first, third, fourth aspects, the two pressing rollers, an interaxial distance between which is fixed, may be pressed against each of at least one of the cantilevered milling rollers to press the milling roller against the corresponding plate part.

In this manner, when the one milling roller is pressed against the plate part by the two pressing rollers, the interaxial distance between which is fixed, the position of the pressing roller can be prevented from shifting relative to the milling roller in the radial direction thereof, thereby reliably pressing the milling roller.

In any one of the first to fourth aspects, at least one of the one milling roller and the other milling roller may be a conical roller.

In this manner, when the conical roller is used as the milling roller, the outer peripheral surface of the milling roller and an end face thereof on a larger-diameter end part side have an angle less than 90°. With this configuration, when two plate parts have an acute setting angle (less than) 90° therebetween, a region near a corner of the setting angle can be milled.

Advantageous Effects of Invention

As described above, a milling apparatus according to the present invention can mill plate parts having different widths without replacing a milling roller, can reliably perform milling up to basal parts of a plurality of differently angled plate parts, and can mill a region near a corner of an acute setting angle between two plate parts.

DESCRIPTION OF EMBODIMENTS

Embodiments of the present invention will be described below with reference to the accompanying drawings.

First Embodiment

Figure 6:
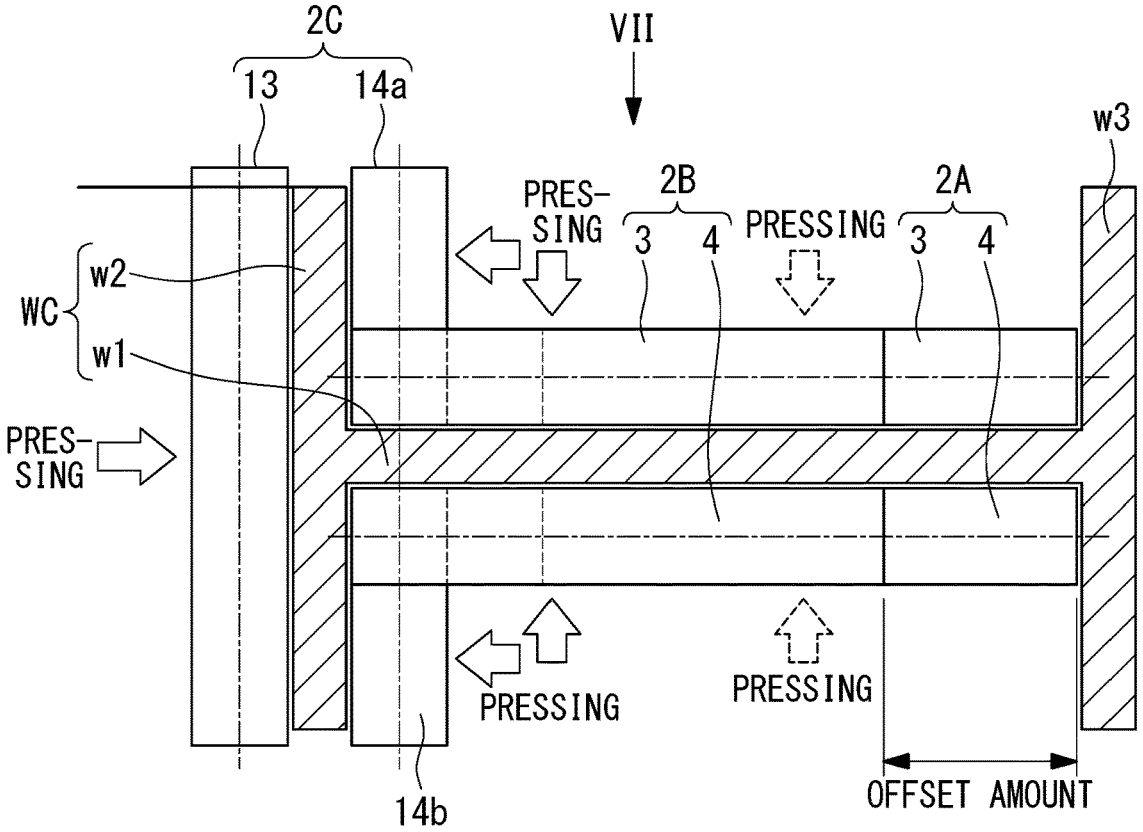
FIG. 6 is a longitudinal sectional view illustrating milling of a milling material having an H-shaped section.
Figure 7:
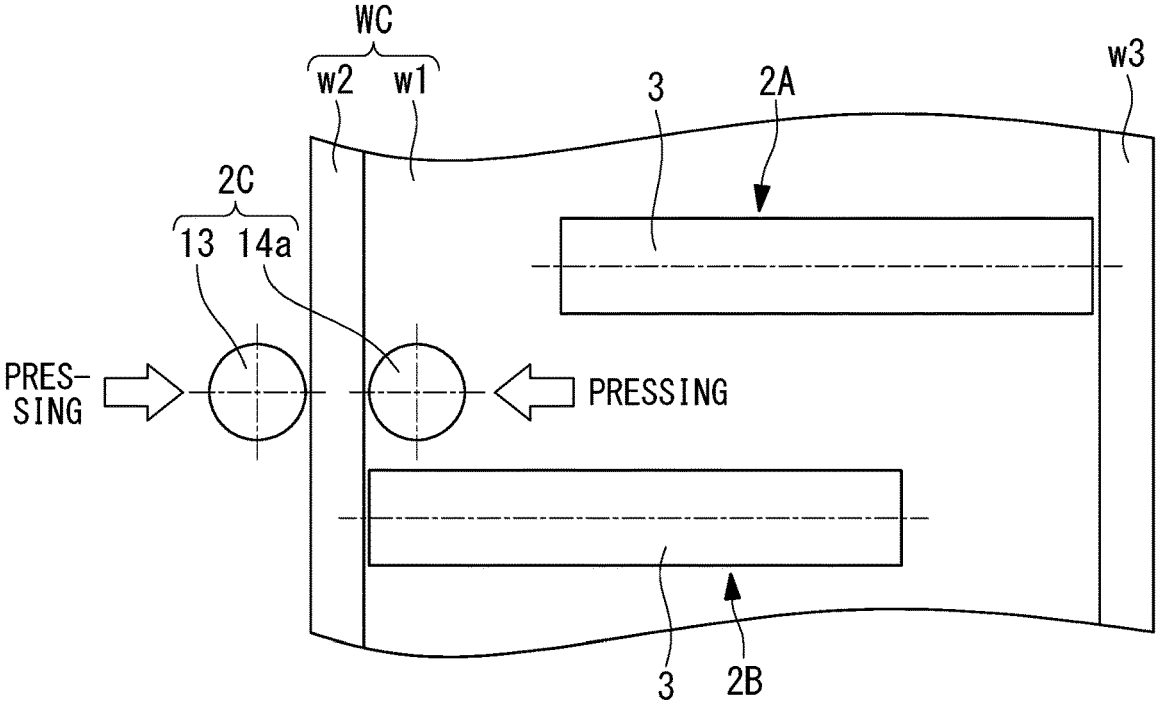
FIG. 7 is a plan view in the direction of arrow VII in FIG. 6.
Figure 8:
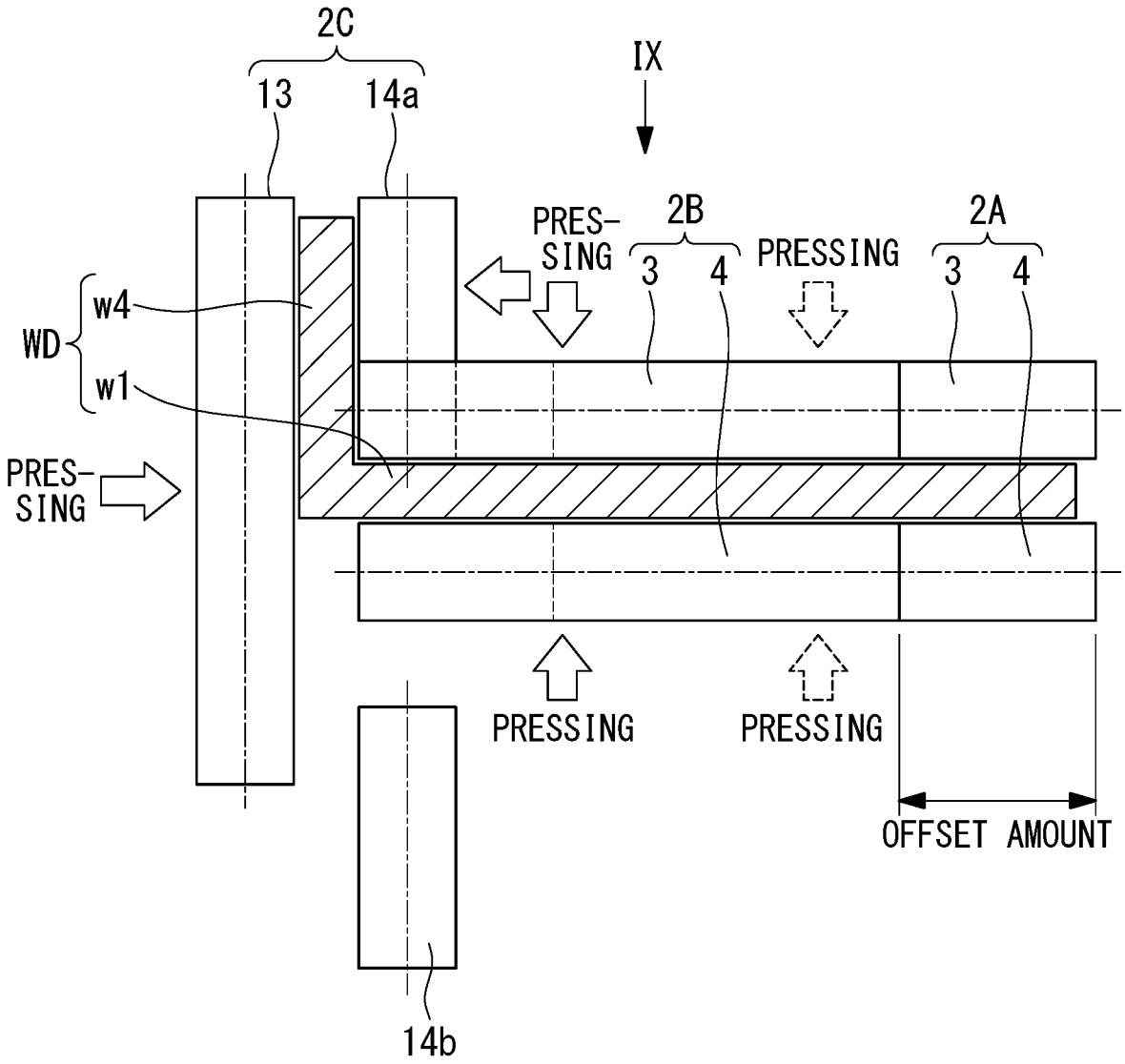
FIG. 8 is a longitudinal sectional view illustrating milling of a milling material having an L-shaped section.
Figure 9:
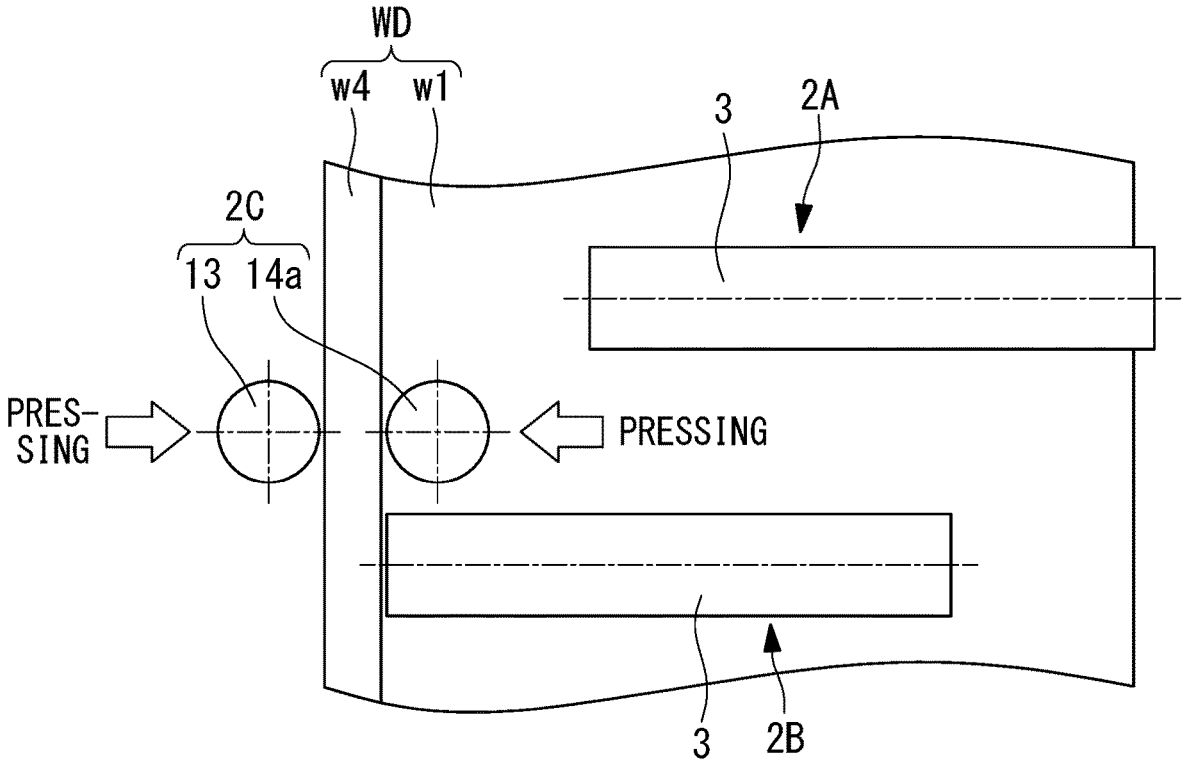
FIG. 9 is a plan view in the direction of arrow IX in FIG. 8.

FIGS. 1A to 1D illustrate a milling apparatus according to a first embodiment of the present invention. This milling apparatus 1 is capable of simultaneously milling at least two of a plurality of differently angled plate parts w1, w2, w3, w4, and w5 included in elongated metal milling materials such as milling materials WA and WB having T-shaped sections as illustrated in FIGS. 1A to 1D and FIGS. 2 to 5, a milling material WC having an H-shaped (I-shaped) section as illustrated in FIGS. 6 and 7, a milling material WD having an L-shaped section as illustrated in FIGS. 8 and 9, and a milling material WE having a crank-shaped section illustrated in FIGS. 10 and 11.

As illustrated in FIGS. 1A to 1D and FIGS. 2 to 5, the milling apparatus 1 includes two milling roller units 2A and 2B and one milling roller unit 2C each including a pair of milling rollers.

For example, the milling roller units 2A and 2B are sequentially installed in the longitudinal direction of the web w1 (plate part) of the milling material WA having a T-shaped section and mill both surfaces of the web w1.

The milling roller unit 2C mills both surfaces of the flange w2 (plate part) of the milling material WA at a milling angle different from those of the milling roller units 2A and 2B by 90°.

The milling roller units 2A and 2B each include a milling roller 3 (one milling roller) that is made contact with one surface of the web w1 by pressing, and a milling roller 4 (the other milling roller) that is made contact with another surface of the web w1 by pressing. The milling rollers 3 and 4 are installed with the axial directions thereof being aligned with the width direction of the web w1, and cantilevered by support units 5 and 6, respectively.

The positions of the support units 5 and 6 supporting the respective milling rollers 3 and 4 in the milling roller unit 2A are opposite to the positions of the support units 5 and 6 supporting the respective milling rollers 3 and 4 in the milling roller unit 2B with respect to the milling rollers 3 and 4. Specifically, the support units 5 and 6 of the milling roller unit 2A are positioned on the web w1 side of the milling material WA, and the support units 5 and 6 of the milling roller unit 2B are positioned opposite to the web w1.

The milling rollers 3 and 4 of each of the milling roller units 2A and 2B, which are cantilevered as described above, are pressed against the web w1 by respective separately provided pressing rollers 7 and 8. The two pressing rollers 7 are provided to each milling roller 3 and supported at both ends by a pair of support units 9 with an interaxial distance between the rollers being fixed. The two pressing rollers 8 are provided to each milling roller 4 and supported at both ends by a pair of support units 10 with an interaxial distance between the rollers being fixed.

In the milling roller units 2A and 2B, pressing force by, for example, a hydraulic cylinder (not illustrated) is uniformly applied to the two pressing rollers 7 and the two pressing rollers 8 through the support units 9 and 10, pressing the pressing rollers 7 and 8 against the milling rollers 3 and 4. The pressing force may be applied to the milling rollers 3 and 4 also through the support units 5 and 6 supporting the respective milling rollers 3 and 4.

In at least one of the milling roller units 2A and 2B, for example, in the milling roller unit 2A, the milling rollers 3 and 4 are movable in the axial directions thereof, which is the width direction of the web w1. This configuration allows offset disposition of the milling roller unit 2A relative to the milling roller unit 2B in the width direction of the web w1. When the milling rollers 3 and 4 of the milling roller unit 2A move in the axial directions, the support units 5 and 6, the pressing rollers 7 and 8, and the support units 9 and 10 integrally move.

The milling roller unit 2C includes a milling roller 13 (one milling roller) that is made contact with one surface (for example, an outer surface) of the flange w2 by pressing, and milling rollers 14*a* and 14*b* (the other milling rollers) that are disposed in line with the web w1 interposed therebetween and made contact with another surface (for example, a surface closer to the web w1) of the flange w2 by pressing. The milling roller 13 is installed such that the axial direction thereof is aligned with the width direction of the flange w2 and supported at both ends by a pair of support units 15. The milling rollers 14*a* and 14*b* are installed facing to the milling roller 13 with the flange w2 interposed therebetween, and are cantilevered by support units 16, respectively.

The two support units 16 support the milling rollers 14*a* and 14*b* at end parts farther from the web w1 among both end parts of the milling rollers 14*a* and 14*b*. With this configuration, leading end sides (not-supported sides) of the cantilevered milling rollers 14*a* and 14*b* face toward the web w1 (a corner of a setting angle between the web w1 and the flange w2).

The milling rollers 14*a* and 14*b* cantilevered as described above are pressed against the flange w2 by separately provided pressing rollers 17*a* and 17*b*, respectively. The two pressing rollers 17*a* are provided to the milling roller 14*a* and supported at both ends by a pair of support units 19*a* with an interaxial distance between the rollers being fixed. The two pressing rollers 17*b* are provided to the milling roller 14*b* and supported at both ends by a pair of support units 19*b* with an interaxial distance between the rollers being fixed.

In the milling roller unit 2C, pressing force by, for example, a hydraulic cylinder (not illustrated) is uniformly applied to the two pressing rollers 17*a* and the two pressing rollers 17*b* through the support units 19*a* and 19*b*, pressing the pressing rollers 17*a* and 17*b* against the milling rollers 14*a* and 14*b*. The pressing force may be applied to the milling rollers 14*a* and 14*b* also through the support units 19*a* and 19*b* supporting the milling rollers 14*a* and 14*b*.

When the milling apparatus 1 configured as described above mills the milling material WA having a T-shaped section as illustrated in FIGS. 1A to 1D, 2, and 3, the milling rollers 3 and 4 of the milling roller units 2A and 2B are placed at offset positions in accordance with the width of the web w1 of the milling material WA.

Specifically, the milling roller unit 2A is moved in the axial direction thereof to perform such adjustment that end parts (end parts on the left side in FIG. 1D) at not-supported sides of the milling rollers 3 and 4 of the milling roller unit 2B are close to the flange w2 and end parts (end parts on the right side in FIG. 1B) at not-supported sides of the milling rollers 3 and 4 of the milling roller unit 2A are positioned outside of an end part of the web w1, which is opposite to the flange w2.

When the milling material WA is milled in this state, the web w1 is milled through the milling roller units 2A and 2B and the flange w2 is milled through the milling roller unit 2C. In the present embodiment, the width of the web w1 is larger than the widths of the milling rollers 3 and 4 of the milling roller units 2A and 2B, but as described above, the milling rollers 3 and 4 of the milling roller unit 2A are placed at offset positions relative to the positions of the milling rollers 3 and 4 of the milling roller unit 2B to achieve uniform milling of the web w1 across the entire width thereof.

Figure 4:
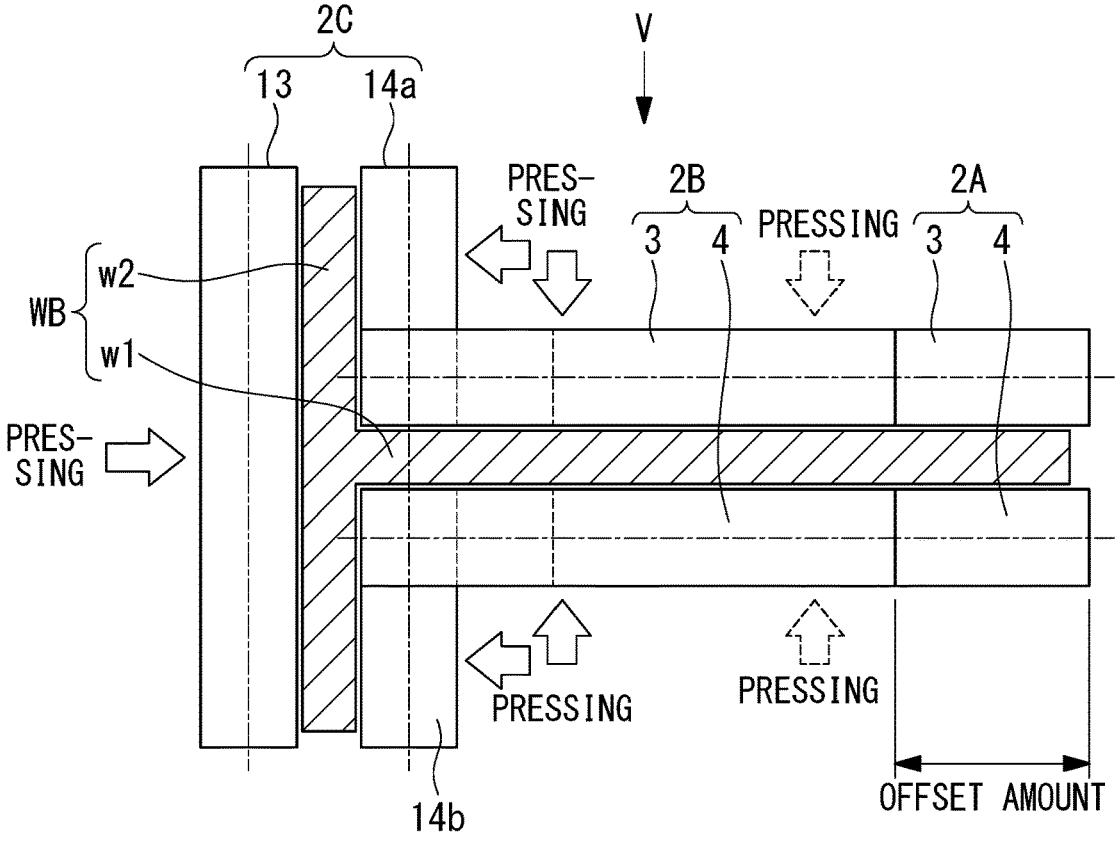
FIG. 4 is a longitudinal sectional view illustrating milling of a milling material having a web width larger than that of the milling material illustrated in FIG. 2.
Figure 5:
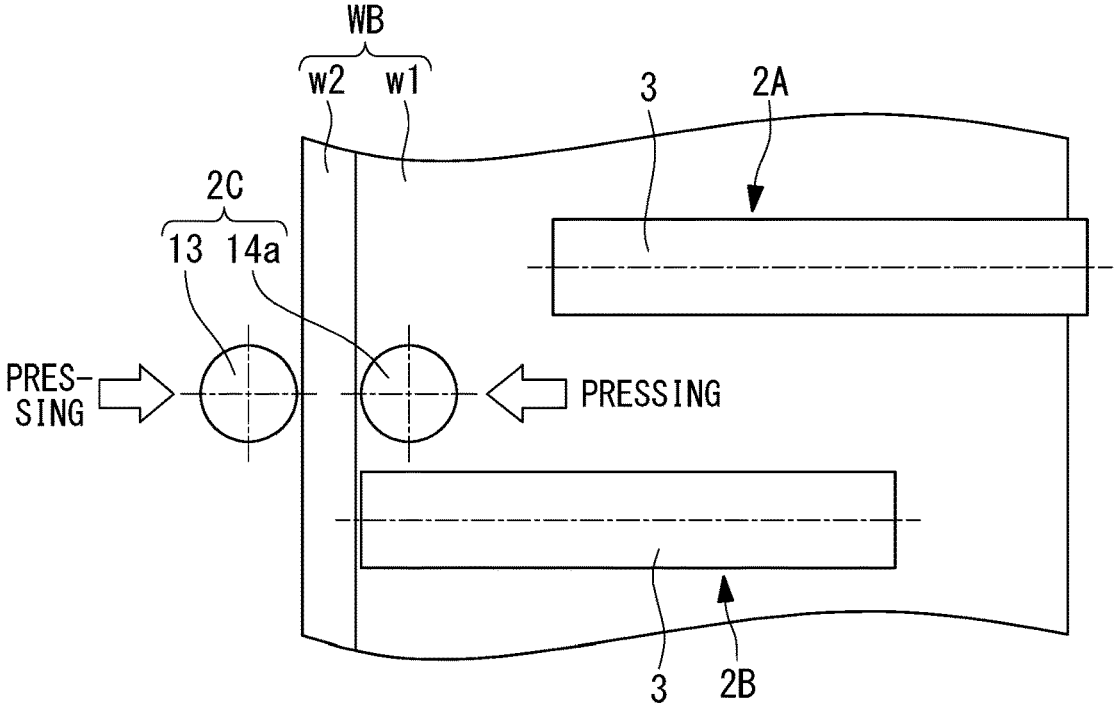
FIG. 5 is a plan view in the direction of arrow IV in FIG. 4.

With this configuration, when the milling material WA is changed to the milling material WB, the web w1 of which has a larger width as illustrated in FIGS. 4 and 5, only offset amounts need to be changed for the milling rollers 3 and 4 of the milling roller units 2A and 2B, but the milling rollers 3 and 4 do not need to be replaced. In this manner, since the milling material WB, the web w1 of which has a different width can be milled without replacing the milling rollers 3 and 4, no time needs to be spent on replacement work of the milling rollers 3 and 4 nor no production line needs to be stopped, thereby preventing degradation of productivity of the milling material WB.

In the milling apparatus 1, the milling rollers 3 and 4 of the milling roller units 2A and 2B and the milling rollers 14*a* and 14*b* of the milling roller unit 2C are cantilevered and pressed against the web w1 and the flange w2 by the pressing rollers 7, 8, 17*a*, and 17*b*.

For example, the web w1 of each of the milling materials WA and WB having sectional shapes formed by connecting a plurality of differently angled plate parts (the web w1 and the flange w2) is milled while the leading end sides (not-supported sides) of the milling rollers 3 and 4 of the milling roller unit 2B are placed facing to the flange w2 (the side of the setting angle between the web w1 and the flange w2) to be milled, as described above.

Accordingly, the milling rollers 3 and 4 of the milling roller unit 2B can be pressed against the web w1 up to positions near the flange w2 (near the position of the setting angle therebetween) while the support units 5 and 6 supporting the respective milling rollers 3 and 4 are prevented from interfering with the flange w2, which is not to be milled by the milling roller unit 2B (the milling rollers 3 and 4). In this manner, milling can be reliably performed up to basal parts of the differently angled plate parts (the web w1 and the flange w2).

In the milling roller units 2A and 2B, the cantilevered milling rollers 3 and 4 are pressed toward the web w1 by the two pressing rollers 7 and the two pressing rollers 8, the interaxial distances between which are fixed by the support units 9 and 10, respectively. In this manner, when the single milling roller 3 or the single milling roller 4 is pressed against the web w1 by the two pressing rollers 7 or 8, the interaxial distances between which are fixed, the pressing rollers 7 or 8 are prevented from being shifted relative to the milling roller 3 or 4, thereby reliably pressing the milling roller 3 or 4 by the pressing rollers 7 or 8.

Figure 1A:
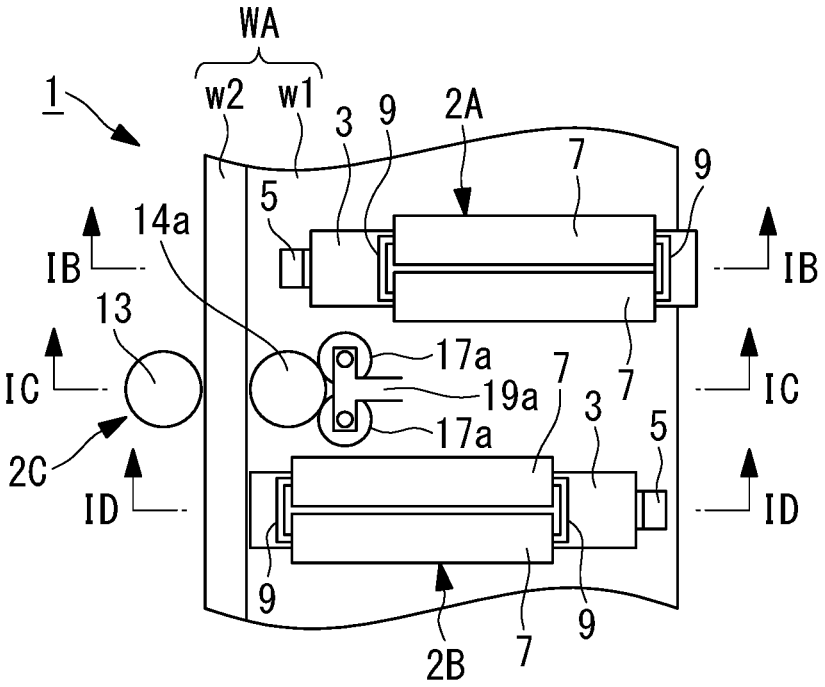
FIG. 1A is a plan view of a milling apparatus according to a first embodiment of the present invention.
Figure 1B:
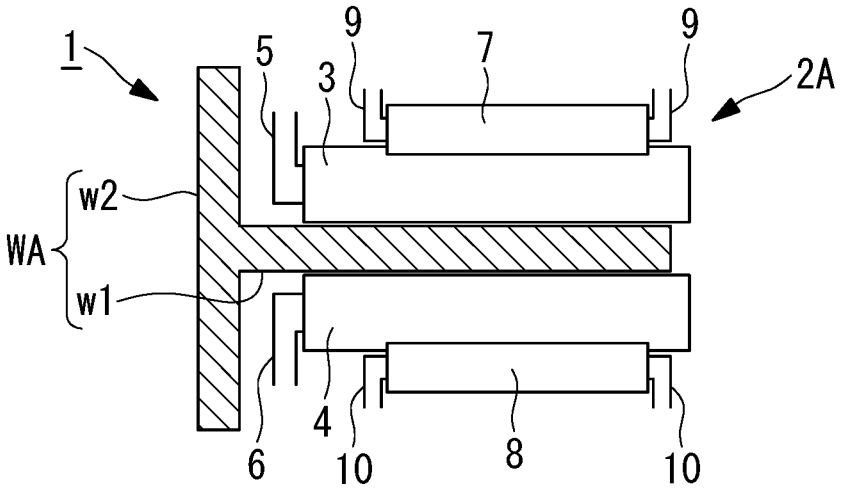
FIG. 1B is a longitudinal sectional view taken along line IB-IB in FIG. 1A.
Figure 1C:
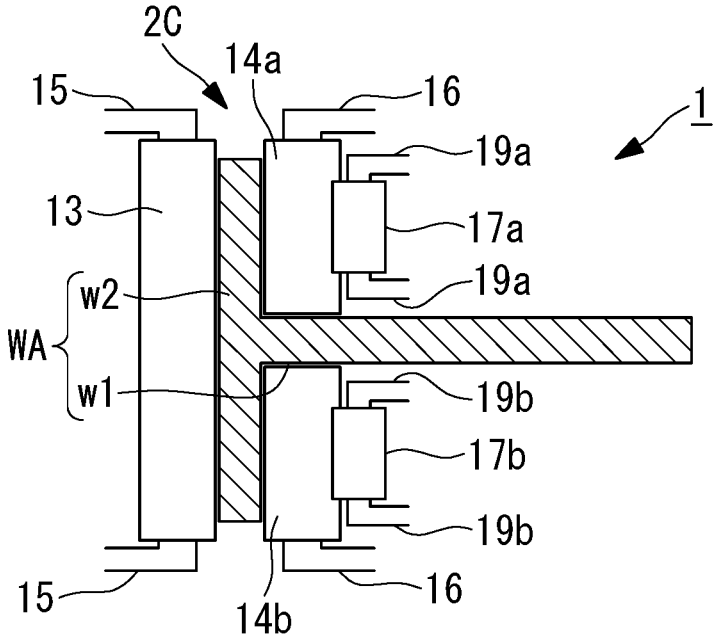
FIG. 1C is a longitudinal sectional view taken along line IC-IC in FIG. 1A.
Figure 1D:
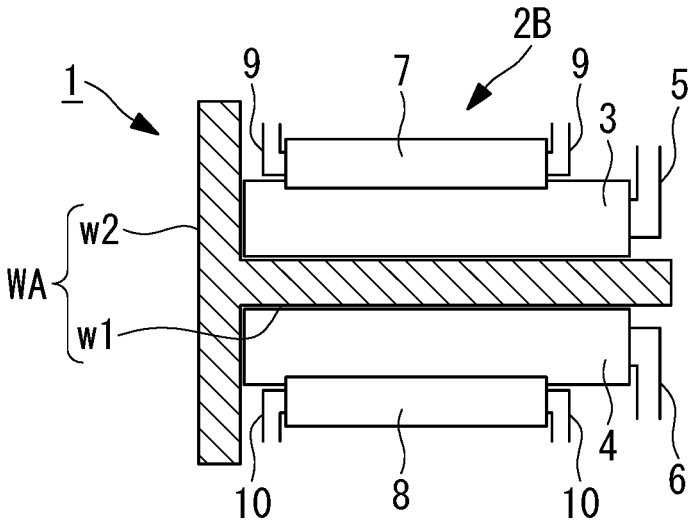
FIG. 1D is a longitudinal sectional view taken along line ID-ID in FIG. 1A.
Figure 2:
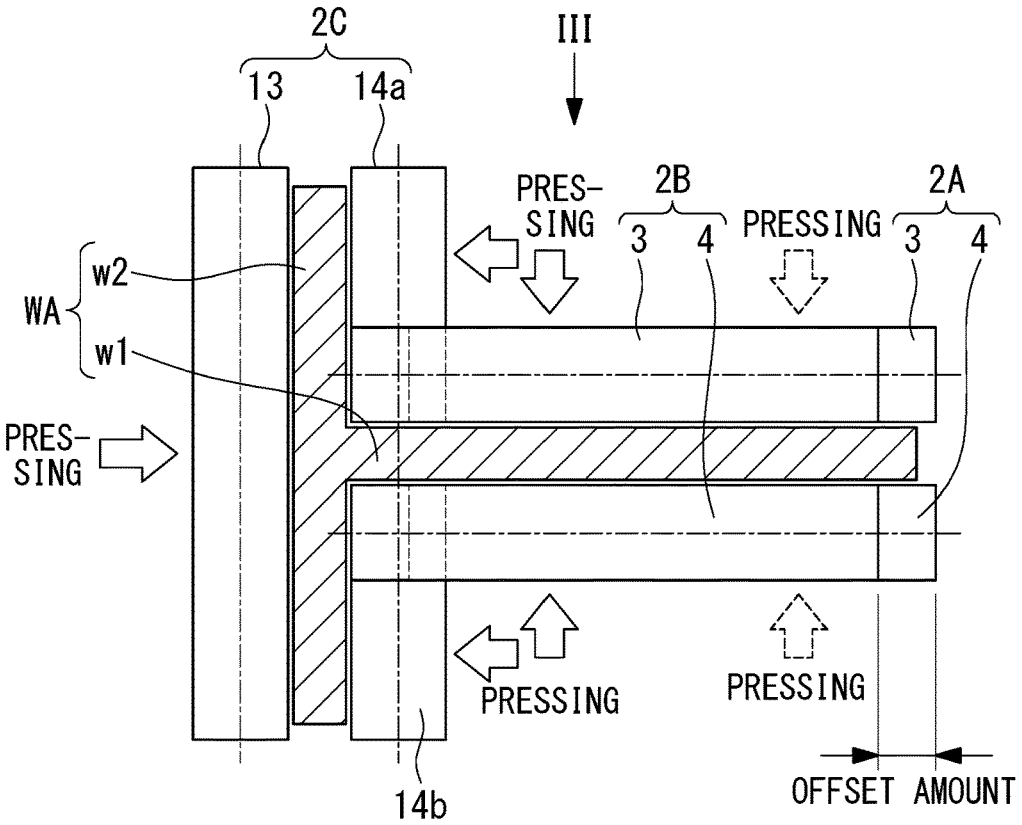
FIG. 2 is a longitudinal sectional view illustrating milling of a milling material having a T-shaped section.
Figure 3:
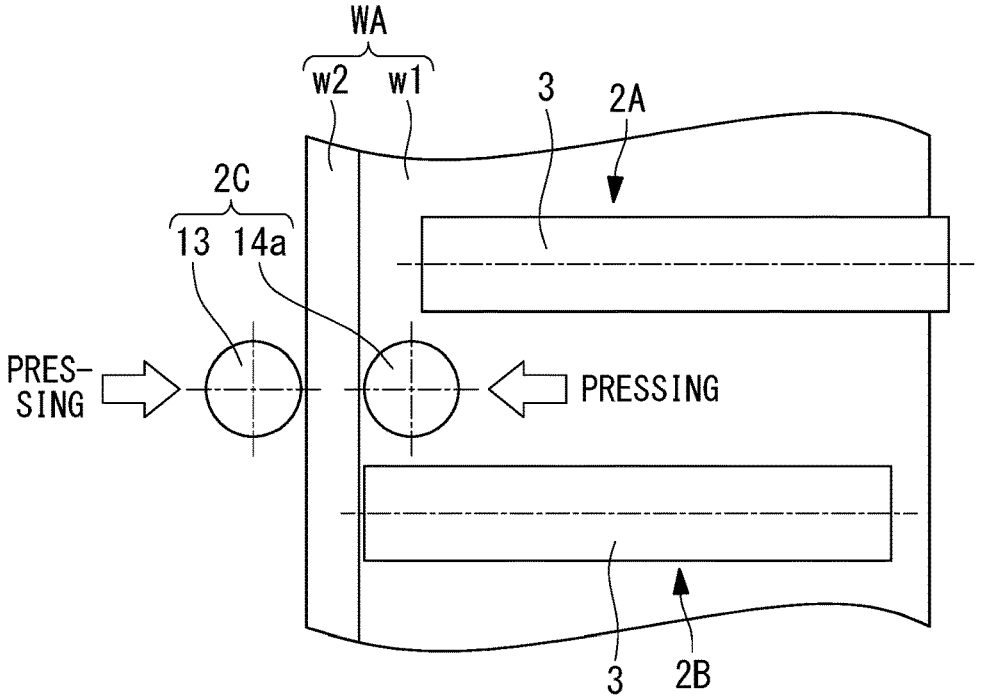
FIG. 3 is a plan view in the direction of arrow III in FIG. 2.

In Example illustrated in FIGS. 2 and 3 and Example illustrated in FIGS. 4 and 5, the flange w2 of the milling material WA or WB before milling is set to have a thickness larger than a thickness after the milling in advance and then milled through the milling roller unit 2C (milling rollers 13, 14*a*, and 14*b*) of the milling apparatus 1, extending the flange w2 in the longitudinal direction thereof to curve the milling material WA or WB at a predetermined curvature. In such a case, the thickness of the web w1 is set to be smaller at a position farther from the flange w2. In sectional shapes when the milling is completed, the web w1 and the flange w2 have equal thicknesses as illustrated in FIGS. 2 and 4.

FIGS. 6 and 7 are each a longitudinal sectional view illustrating milling of the milling material WC having an H-shaped section by the milling apparatus 1. The milling material WC includes the flange w2 at one side of the web w1 and the flange w3 at the other side.

When the milling material WC having an H-shaped section is to be milled, the positions of the milling rollers 3 and 4 in the axial directions thereof, in other words, offset amounts of the milling rollers 3 and 4 are adjusted so that end parts (end parts on the left side in FIGS. 6 and 7) at the not-supported sides of the milling rollers 3 and 4 of the milling roller unit 2B are close to the flange w2, and end parts (end parts on the right side in FIGS. 6 and 7) at the not-supported sides of the milling rollers 3 and 4 of the milling roller unit 2A are close to the flange w3.

Accordingly, the web w1 is uniformly milled across the entire width thereof through the milling roller units 2A and 2B (the two pairs of milling rollers 3 and 4), and the flange w2 is milled through the milling roller unit 2C. In Example illustrated in FIGS. 6 and 7, the flange w2 of the milling material WC is set have a thickness larger than the thickness of the flange w3 in advance and then milled through the milling roller unit 2C (milling rollers 13, 14*a*, and 14*b*) of the milling apparatus 1, extending the flange w2 in the longitudinal direction thereof, without milling the flange w3, to curve the milling material WC at a predetermined curvature. In such a case, the web w1 is set to have a thickness smaller in a direction from the flange w2 to the flange w3. In a sectional shape when the milling is completed, the web w1, the flange w2, and the flange w3 have equal thicknesses as illustrated in FIG. 6.

FIGS. 8 and 9 are each a longitudinal sectional view illustrating milling of the milling material WD having an L-shaped section by the milling apparatus 1. The milling material WD includes the flange w4 on one side of the web w1 but no flange on the other side of the web w1. The flange w4 is shaped by bending an end face of the web w1 at right angle.

When the milling material WD having an L-shaped section is to be milled, the position of the milling roller unit 2A in the axial direction thereof, which is the offset amount of the milling roller unit 2A relative to the milling roller unit 2B, is adjusted so that an end part (end part on the left side in FIGS. 8 and 9) at the not-supported side of the milling roller 3 of the milling roller unit 2B is close to the flange w4, and end parts (end parts on the right side in FIGS. 8 and 9) at the not-supported sides of the milling rollers 3 and 4 of the milling roller unit 2A are positioned outside of an end part of the web w1, which is opposite to the flange w4.

Accordingly, the web w1 is uniformly milled across the entire width thereof through the milling roller units 2A and 2B (the two pairs of milling rollers 3 and 4), and the flange w4 is milled through the milling roller unit 2C (milling rollers 13 and 14*a*). The milling roller 14*b* included in the milling roller unit 2C is not used and thus is retracted to a position where the milling roller 14*b* does not interfere with the milling material WD and any other milling roller.

In Example illustrated in FIGS. 8 and 9, the flange w4 is set to have a thickness larger than that of a final shape in advance, and the web w1 is set to have a thickness smaller at a position farther from the flange w4 in advance. Then, the milling apparatus 1 mills the web w1 and the flange w4 and at the same time extends the flange w4 in the longitudinal direction thereof to curve the milling material WD at a predetermined curvature. In a sectional shape when the milling is completed, the web w1 and the flange w4 have equal thicknesses as illustrated in FIG. 8.

Figure 10:
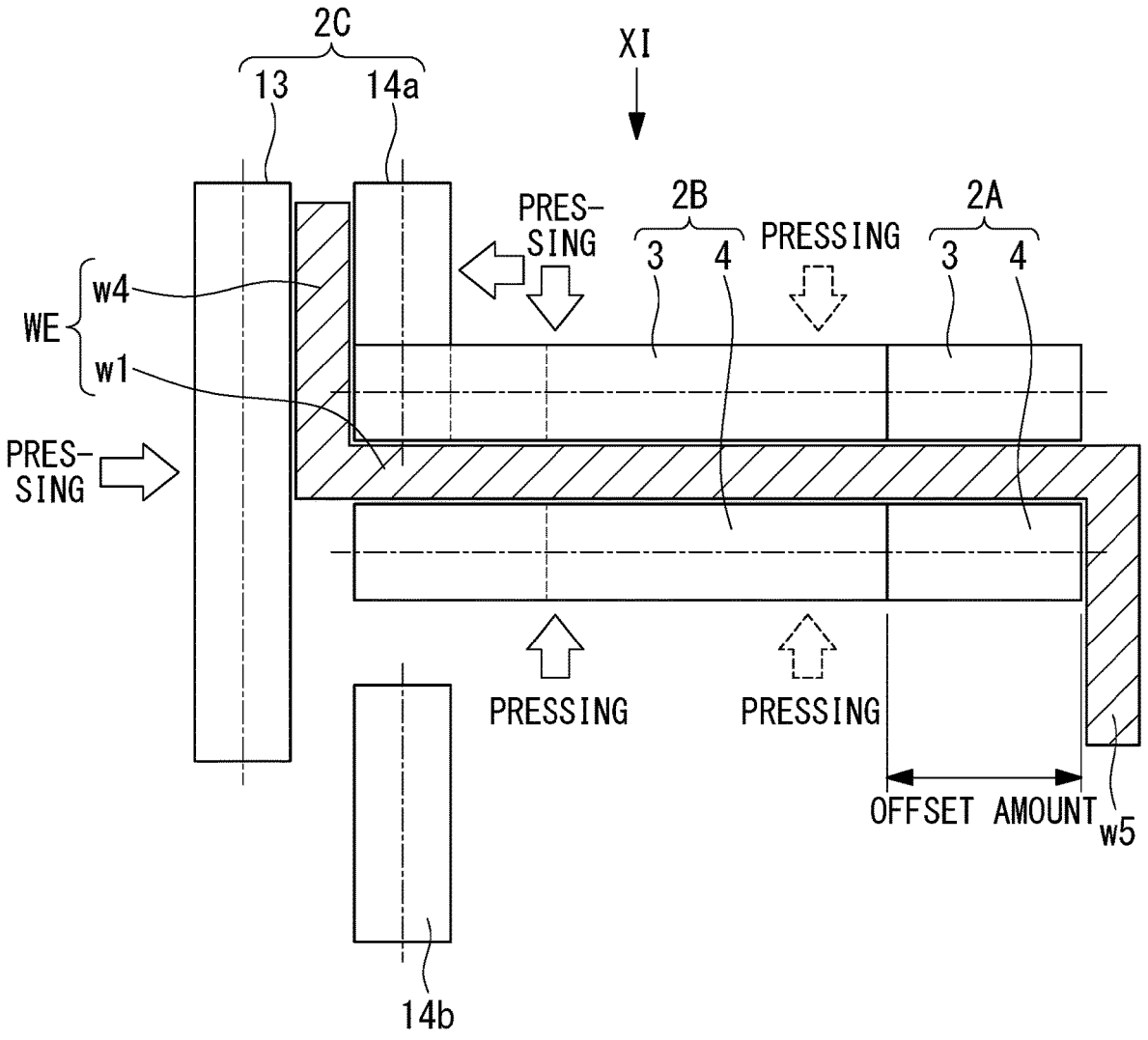
FIG. 10 is a longitudinal sectional view illustrating milling of a milling material having a crank-shaped section.
Figure 11:
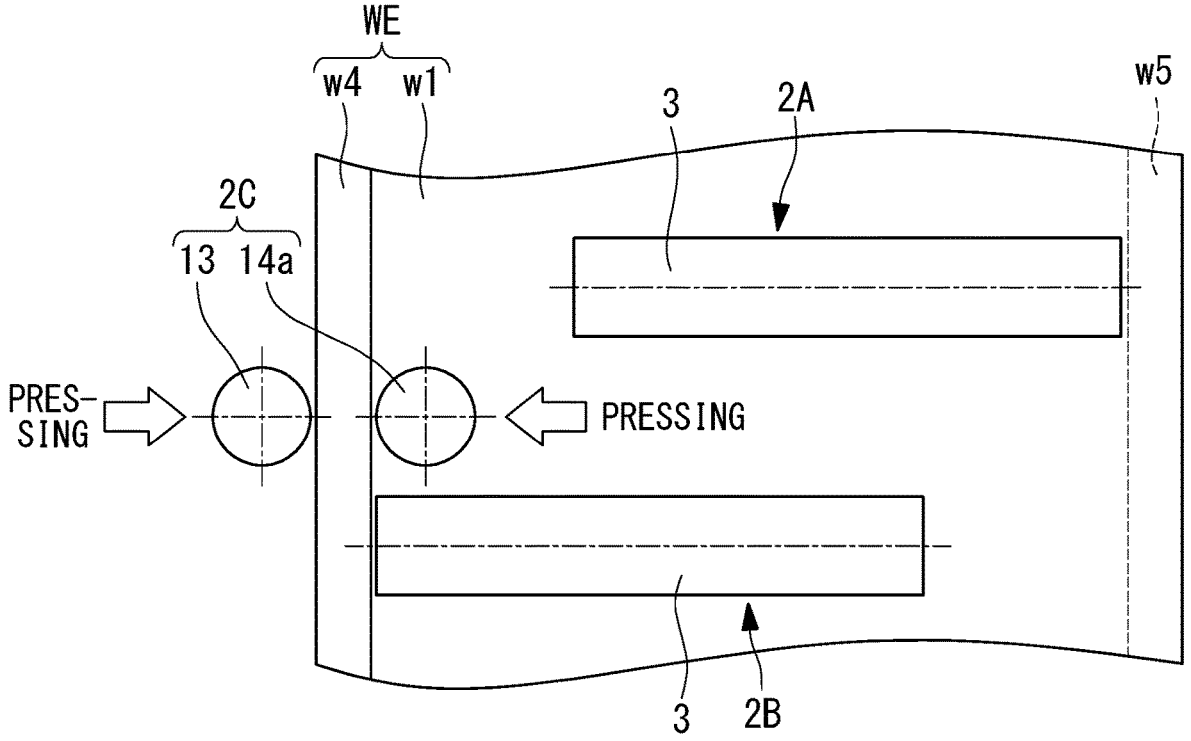
FIG. 11 is a plan view in the direction of arrow XI in FIG. 10.
Figure 12A:
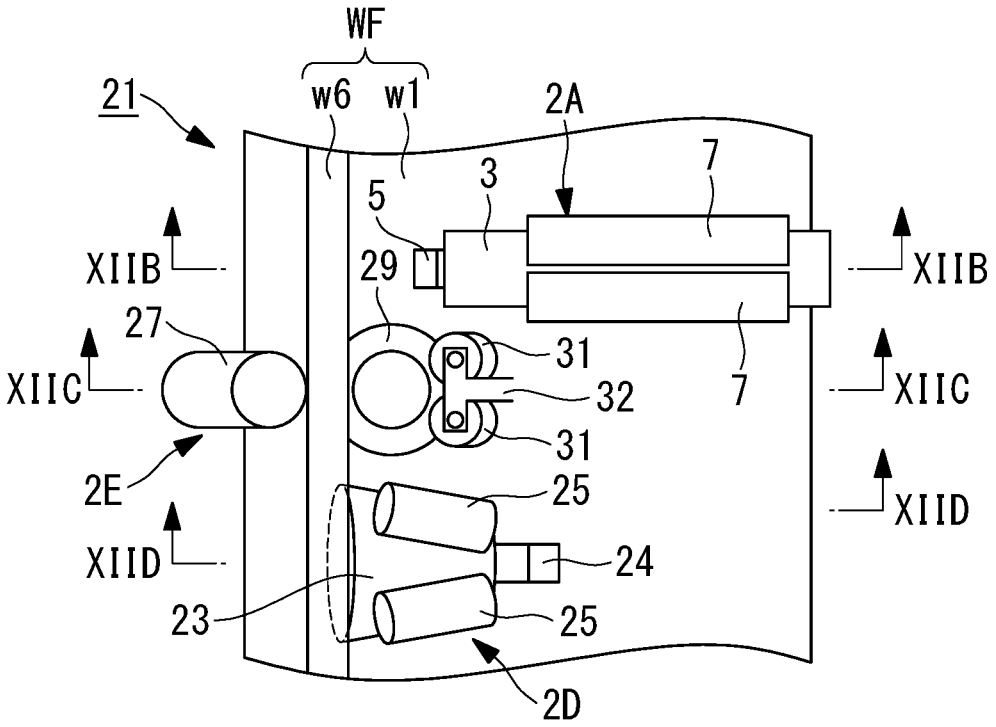
FIG. 12A is a plan view of a milling apparatus according to a second embodiment of the present invention.
Figure 12B:
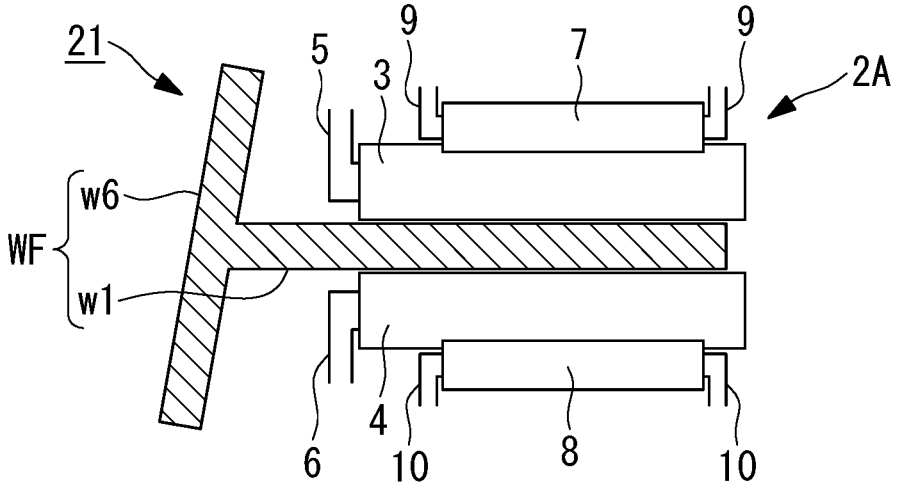
FIG. 12B is a longitudinal sectional view taken along line XIIB-XIIB in FIG. 12A.
Figure 12C:
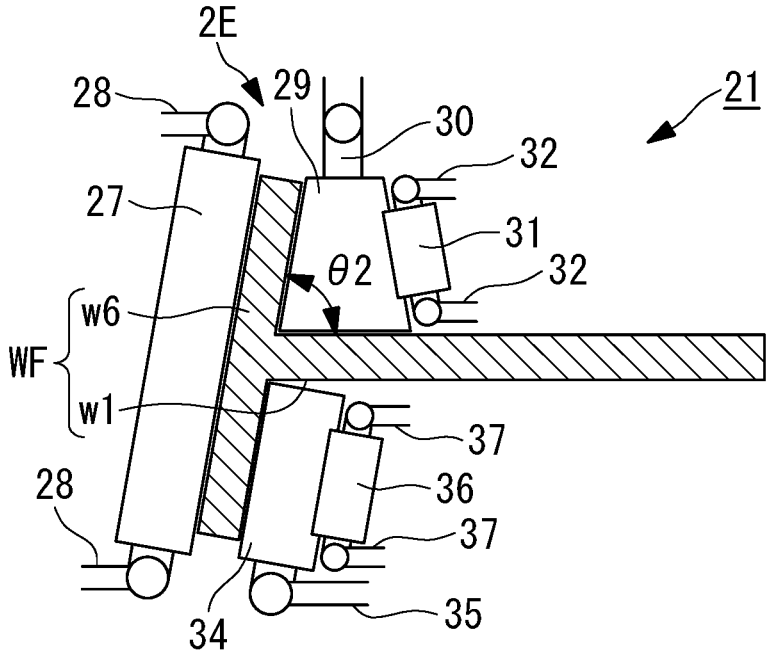
FIG. 12C is a longitudinal sectional view taken along line XIIC-XIIC in FIG. 12A.
Figure 12D:
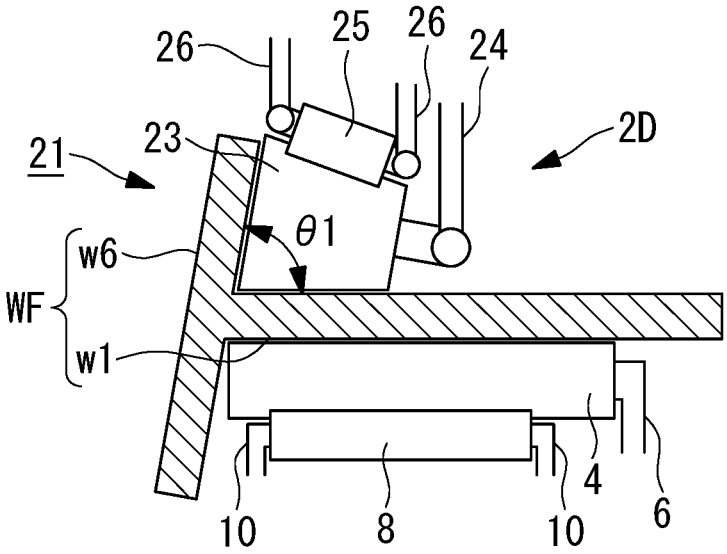
FIG. 12D is a longitudinal sectional view taken along line XIID-XIID in FIG. 12A.

FIGS. 10 and 11 are each a longitudinal sectional view illustrating milling of the milling material WE having a crank-shaped section by the milling apparatus 1. The milling material WE includes the flange w4, which is same as that illustrated in FIG. 8, on one side of the web w1, and includes the flange w5, which has a height same as that of the flange w4, at a point-symmetrical position on the other side of the web w1.

When the milling material WE having a crank-shaped section is to be milled, the position (offset amount) of the milling roller unit 2A in the axial direction thereof is adjusted so that an end part (end part on the left side in FIGS. 10 and 11) at the not-supported side of the milling roller 3 of the milling roller unit 2B is close to the flange w4, and an end part (end part on the right side in FIGS. 10 and 11) at the not-supported side of the milling roller 4 of the milling roller unit 2A is close to the flange w5.

Accordingly, the web w1 is uniformly milled across the entire width thereof through the milling roller units 2A and 2B (the two pairs of milling rollers 3 and 4), and the flange w4 is milled through the milling roller unit 2C (milling rollers 13 and 14*a*). The milling roller 14*b* included in the milling roller unit 2C is not used and thus is retracted to a position where the milling roller 14*b* does not interfere with the milling material WE and any other milling roller.

In Example illustrated in FIGS. 10 and 11, the flange w4 is set to have a thickness larger than that of a final shape in advance, and the web w1 is set to have a thickness smaller in a direction from the flange w4 to the flange w5 in advance. Then, the milling apparatus 1 mills the web w1 and the flange w4 and at the same time extends the flange w4 in the longitudinal direction thereof to curve the milling material WE at a predetermined curvature. In a sectional shape when the milling is completed, the web w1, the flange w4, and the flange w5 have equal thicknesses as illustrated in FIG. 10.

Second Embodiment

FIGS. 12A to 12D illustrate a milling apparatus according to a second embodiment of the present invention. Similarly to the milling apparatus 1 illustrated in FIGS. 1A to 1D, this milling apparatus 21 is capable of simultaneously milling two of a plurality of differently angled plate parts w1 and w6 (the web w1 and the flange w6) of an elongated metal milling material WF. The web w1 and the flange w6 have a setting angle (relative angle) therebetween that is not at right angle for sake of description of functions of the milling apparatus 21, but may have the setting angle at right angle.

The milling apparatus 21 includes three milling roller units 2A, 2D, and 2E. The milling roller unit 2A has a structure same as that of the milling apparatus 1 according to the first embodiment illustrated in FIGS. 1A to 1D, and thus any identical components are denoted by an identical reference sign, and description thereof will be omitted. The milling roller unit 2A mills a region of the web w1, which is opposite to the flange w6.

The milling roller unit 2D mills a region of the web w1, which is closer to the flange w6, and includes a conical milling roller 23 (one milling roller) that is made contact with one surface of the web w1 by pressing, and a cylindrical milling roller 4 (the other milling roller) that is made contact with another surface of the web w1 by pressing. The cylindrical milling roller 4, a support unit 6 that cantilevers the milling roller 4, a pressing roller 8 that presses the milling roller 4 toward the web w1, and a support unit 10 of the pressing roller 8 are same as those of the milling roller unit 2B of the milling apparatus 1 according to the first embodiment.

A relative angle θ1 between an outer peripheral surface (conical surface) of the milling roller 23 and an end face of the milling roller 23, which is closer to the flange w6, is smaller than the setting angle between the web w1 and the flange w6. The milling roller 23 is cantilevered by a support unit 24 including a joint, while a bottom surface thereof on a larger-diameter end part side faces to the flange w6 and the outer peripheral surface contacts the web w1. The milling roller 23 cantilevered in this manner is pressed against the web w1 by two separately provided pressing rollers 25. The pressing rollers 25 are supported at both ends with an interaxial distance between the rollers being fixed by a pair of support units 26 each including a joint.

The joint of the support unit 24 cantilevering the milling roller 23 is rotatable, and thus the outer peripheral surface (conical surface) of the milling roller 23 can be uniformly made in contact with the web w1. The joints of the support units 26 supporting the pressing rollers 25 at both ends are rotatable, and thus the angle of the axis line of each pressing roller 25 is changeable to align with a direction along the outer peripheral surface of the milling roller 23 pressed by the pressing roller 25.

The milling roller unit 2E mills the flange w6 and includes a cylindrical milling roller 27 (one milling roller) that is made contact with one surface (for example, an outer surface) of the flange w6 by pressing, and a conical milling roller 29 (the other milling roller) and a cylindrical milling roller 34 (the other milling roller) that are disposed in line with the web w1 interposed therebetween and made contact with another surface (for example, a surface closer to the web w1) of the flange w6 by pressing.

The cylindrical milling roller 27 is installed so that the axial direction thereof is aligned with the width direction of the flange w6, and is supported at both ends by a pair of support units 28 each including a joint. The joints of the support units 28 are movable, and thus the milling roller 27 can be differently angled. With this configuration, an outer peripheral surface of the milling roller 27 can be uniformly made in contact with the flange w6 in accordance with the tilt angle of the flange w6.

A relative angle θ2 between an outer peripheral surface (conical surface) of the conical milling roller 29 and an end face of the conical milling roller 29 on a larger-diameter end part side is smaller than the setting angle between the web w1 and the flange w6. The milling roller 29 is cantilevered by a support unit 30 including a joint, while the end face on the larger-diameter end part side faces to the web w1 and the outer peripheral surface (conical surface) contacts an inner surface of the flange w6. The milling roller 29 cantilevered in this manner is pressed against the flange w6 by two separately provided pressing rollers 31. The pressing rollers 31 are supported at both ends with an interaxial distance between the rollers being fixed by a pair of support units 32 each including a joint, and thus the angle of the axis line of each pressing roller 31 is changeable to align with a direction along the outer peripheral surface of the milling roller 29 pressed by the pressing roller 31.

The cylindrical milling roller 34 is cantilevered by a support unit 35 including a joint, while an end face on a not-supported side of the milling roller 34 faces to the web w1 and an outer peripheral surface thereof contacts the inner surface of the flange w6. The milling roller 34 cantilevered in this manner is pressed against the flange w6 by two separately provided pressing rollers 36. The pressing rollers 36 are supported at both ends with an interaxial distance between the rollers being fixed by a pair of support units 37 each including a joint.

When the milling apparatus 21 configured as described above mills the milling material WF, the setting angle between the web w1 and the flange w6 of which is not at right angle as illustrated in FIGS. 12A to 12D, the milling rollers 3 and 4 of the milling roller unit 2A and the milling rollers 23 and 4 of the milling roller unit 2D are placed at offset positions in accordance with the width of the web w1 of the milling material WF.

Specifically, the milling roller unit 2A is moved in the axial direction thereof to perform such adjustment that end parts (end parts on the left side in FIG. 12D) at the not-supported sides of the milling rollers 23 and 4 of the milling roller unit 2D are close to the flange w6 and end parts (end parts on the right side in FIG. 12B) at the not-supported sides of the milling rollers 3 and 4 of the milling roller unit 2A are positioned outside of an end part of the web w1, which is opposite to the flange w6 side.

When the milling material WF is milled in this state, the web w1 is milled through the milling roller units 2A and 2D and the flange w6 is milled through the milling roller unit 2E. In the present embodiment, the width of the web w1 is larger than the widths of the milling rollers 3, 4, and 23 of the milling roller units 2A and 2D, but as described above, the milling rollers 3 and 4 of the milling roller unit 2A are placed at offset positions relative to the positions of the milling rollers 4 and 23 of the milling roller unit 2D to achieve uniform milling of the web w1 across the entire width thereof.

In the milling apparatus 21, the angles of the axis lines of the pressing rollers 25, 31, and 36 pressing the milling rollers 23, 29, and 34 are changeable to align with directions along the outer peripheral surfaces of the milling rollers 23, 29, and 34. Thus, even with the conical milling rollers 23 and 29, the pressing rollers 25 and 31 can be reliably pressed against the conical outer peripheral surfaces of the milling rollers 23 and 29, thereby applying pressing force. When the milling roller 34 in the present embodiment, which is not conical but cylindrical, is tilted, the pressing rollers 36 can be reliably pressed in accordance with the tilt angle.

In addition, since the milling apparatus 21 includes the plurality of conical milling rollers 23 and 29 and the outer peripheral surface and the end face of each of the milling rollers 23 and 29 have an angle less than 90° therebetween, a region near a corner of the setting angle between the web w1 and the flange w6 of the milling material WF can be effectively milled when the setting angle is an acute angle (less than 90°).

Although the milling rollers 23 and 29 are conical rollers in the present embodiment, for example, the milling rollers 4 and 34 are conical rollers. With this configuration, too, a region near the corner of the setting angle can be effectively milled when the flange w6 is tilted relative to the web w1 in an opposite direction (when a lower surface of the web w1 and the inner surface of the flange w6 have an acute angle therebetween).

Any other operation and effect are same as that of the milling apparatus 1 according to the first embodiment, and thus description thereof is omitted.

As described above, the milling apparatuses 1 and 21 according to the embodiments can mill plate parts (such as a web and a flange) having different widths in the milling materials WA to WF without replacing a milling roller, can reliably perform milling up to basal parts of a plurality of differently angled plate parts, and can mill a region near a corner of an acute setting angle between two plate parts.

The present invention is not limited only to the configurations described above in the first and second embodiments, but may be changed and modified as appropriate without departing from the scope of the present invention. Any embodiment changed and modified in this manner is included in the scope of right of the present invention.

For example, the milling materials WA to WF are not limited to the sectional shapes described above in the embodiments, but may have any other sectional shapes. The kinds and arrangements, etc. of milling rollers may be different from those described above in the embodiments.

REFERENCE SIGNS LIST

1, 21 Milling apparatus
2A to 2E Milling roller unit
3, 13, 23, 27 Milling roller (one milling roller)
4, 14*a*, 14*b*, 29, 34 Milling roller (the other milling roller)
5, 6, 9, 10, 15, 16, 19*a*, 19*b* Support unit
7, 8, 17*a*, 17*b*, 25, 31, 36 Pressing roller
WA to WF Milling material
w1 Web (plate part)
w2 to w6 Flange (plate part)

The invention claimed is:

1. A milling apparatus capable of milling an elongated metal milling material having a plurality of differently angled plate parts, the milling apparatus comprising:

a plurality of milling roller units each including a first milling roller that is made to contact with one surface of at least one of the plurality of differently angled plate parts by pressing and a second milling roller that is made to contact with another surface of the at least one of the plurality of differently angled plate parts by pressing, wherein at least two milling roller units of the plurality of milling roller units are installed in a longitudinal direction of one plate part of the plurality of differently angled plate parts to mill the one plate part, and the first and second milling rollers of at least one of the at least two milling roller units are movable in axial directions of the first and second milling rollers of the at least one of at least two milling roller units, respectively, each axial direction of the axial directions being transverse to the longitudinal direction of the one plate part, the first and second milling rollers of one of the at least two milling roller units are placed at an offset position corresponding to a width of the one plate part extending in the axial direction, the offset position being relative to the first and second milling rollers of another of the at least two milling roller units, at least one of the first or second milling roller of at least one of the plurality of milling roller units is cantilevered and pressed against the at least one of the plurality of differently angled plate parts by a separately provided pressing roller, and an angle of an axis line of the pressing roller is changeable to align with a direction along an outer peripheral surface of the first or second milling roller pressed by the pressing roller.

2. The milling apparatus according to claim 1, further comprising another pressing roller, wherein an interaxial distance between the pressing roller and the another pressing roller is fixed, and the pressing roller and the another pressing roller are pressed against the at least one of the cantilevered first or second milling roller to press against the at least one of the plurality of differently angled plate parts.

3. The milling apparatus according to claim 1, wherein at least one of the first milling roller or the second milling roller of the at least two milling roller units is a conical roller.

4. A milling apparatus capable of milling an elongated metal milling material having a plurality of differently angled plate parts, the milling apparatus comprising:

a plurality of milling roller units each including a first milling roller that is made to contact with one surface of at least one of the plurality of differently angled plate parts by pressing and a second milling roller that is made to contact with another surface of the at least one of the plurality of differently angled plate parts by pressing, wherein the plurality of milling roller units includes at least one milling roller unit having the first and second milling rollers configured to mill a first plate part of the plurality of differently angled plate parts, and another milling roller unit having the first and second milling rollers configured to mill, simultaneously with the at least one milling roller unit, one surface and another surface of a second plate part having an angle different from the first plate part milled by the at least one milling roller unit, at least one of the first or second milling roller of at least one of the plurality of milling roller units is cantilevered and pressed against the at least one of the plurality of differently angled plate parts by a separately provided pressing roller, and an angle of an axis line of the pressing roller is changeable to align with a direction along an outer peripheral surface of the first or second milling roller pressed by the pressing roller.

5. A milling apparatus capable of milling an elongated metal milling material having a plurality of differently angled plate parts, the milling apparatus comprising:

a plurality of milling roller units each including a first milling roller that is made to contact with one surface of at least one of the plurality of differently angled plate parts by pressing and a second milling roller that is made to contact with another surface of the at least one of the plurality of differently angled plate parts by pressing, wherein the plurality of milling roller units includes at least two milling roller units configured to mill a first plate part of the plurality of differently angled plate parts, and installed in a longitudinal direction of the first plate part, the first and second milling rollers of at least one of the at least two milling roller units being movable in axial directions of the first and second milling rollers of the at least one of the at least two milling roller units, respectively, each axial direction of the axial directions being transverse to the longitudinal direction, and at least one milling roller unit configured to mill, simultaneously with the at least two milling roller units, a second plate part of the plurality of differently angled plate parts having an angle different from the first plate part milled by the at least two milling roller units, the first and second milling rollers of one of the at least two milling roller units are placed at an offset position in accordance with a width of the first plate part extending in the axial direction, the offset position being relative to the first and second milling rollers of another of the at least two milling roller units, at least one of the first or second milling roller of at least one of the plurality of milling roller units is cantilevered and pressed against the at least one of the plurality of differently angled plate parts by a separately provided pressing roller, and an angle of an axis line of the pressing roller is changeable to align with a direction along an outer peripheral surface of the first or second milling roller pressed by the pressing roller.

6. The milling apparatus according to claim 5, wherein the first and second milling rollers of the at least one milling roller unit of the plurality of milling roller units mill the second plate part of the plurality of differently angled plate parts, and the first and second milling rollers of each of the at least two milling roller units mill one surface and another surface of the first plate part having the angle different from the second plate part milled by the at least one milling roller unit.

* * * * *